US005404624A

United States Patent [19]

Joseph

[11] Patent Number: 5,404,624

[45] Date of Patent: Apr. 11, 1995

[54] ATTACHMENT FOR SAFETY PIN WITH IDENTIFYING INDICIA

[76] Inventor: John M. Joseph, 2827 Echo Way, Sacremento, Calif. 95821

[21] Appl. No.: 168,149

[22] Filed: Dec. 17, 1993

[51] Int. Cl.[6] ..... A44B 9/00

[52] U.S. Cl. ..... 24/709; 24/709.9; 24/710

[58] Field of Search ..... 24/709, 709.9, 709.8, 24/709.7, 709.6, 709.5, 709.4, 710; 40/159, 330

[56] References Cited

U.S. PATENT DOCUMENTS

| | | | |
|---|---|---|---|
| 777,804 | 12/1904 | Poole | 24/709.5 |
| 1,041,932 | 10/1912 | Williams | 24/709.9 |
| 1,369,822 | 3/1921 | Lynch | 24/708.5 |
| 1,868,563 | 7/1932 | Cicourel | 40/330 |
| 3,179,995 | 4/1965 | Hawk | 24/709.8 |
| 3,517,421 | 6/1970 | Lewis | 24/709.8 |
| 3,705,586 | 12/1972 | Sarracino | 24/543 |
| 4,074,396 | 2/1978 | Swimley | 24/709.9 |
| 4,417,410 | 11/1983 | Freedom | 40/330 |
| 4,852,220 | 8/1989 | Berardi | 24/710 |
| 5,077,868 | 1/1992 | Visser | 24/301 |

FOREIGN PATENT DOCUMENTS

| | | | |
|---|---|---|---|
| 0067076 | 11/1957 | France | 24/709.8 |
| 1225297 | 3/1971 | United Kingdom | 24/710 |

*Primary Examiner*—Victor N. Sakran
*Attorney, Agent, or Firm*—Alfred Hoyte

[57] ABSTRACT

A safety pin attachment which is capable of being releaseably locked about a conventional safety pin. The attachment has a male half and a female half which are adapted for mutual locking engagement. In one embodiment, the male half and the female half are injection molded adjacent each other and lying in the same plane, connected by a living hinge. The living hinge allows the two halves to be folded together until they are releaseably locked about the safety pin.

5 Claims, 6 Drawing Sheets

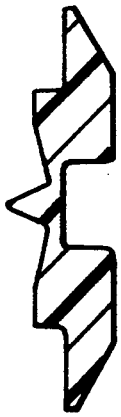
FIG. 5a
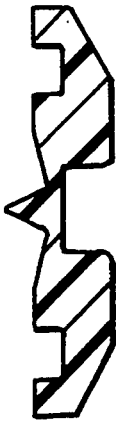
FIG. 5b
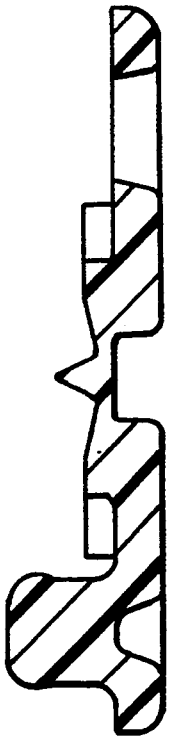
FIG. 5c
FIG. 4
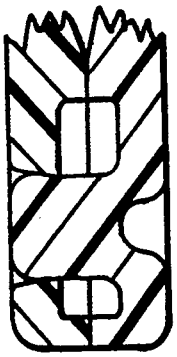

ATTACHMENT FOR SAFETY PIN WITH IDENTIFYING INDICIA

BACKGROUND OF THE INVENTION

The present invention relates to an attachment for a conventional safety pin.

A typical conventional safety pin has first and second wire limbs, the first wire limb having a cap at one end and the second wire limb having a pointed free end, and a coiled portion opposite the cap end of the first wire limb which provides a connection for the first and second wire limbs. The cap has a recess opening towards the first wire limb which is adapted to engage the free end of the second wire limb which is movable between an engaged and a non-engaged position.

The present invention contemplates an attachment for a safety pin which can be used to provide an additional gripping mass and also have identifying indicia to identify characteristics associated with items to which the safety pin is attached.

The problem with the conventional safety pin is that it is difficult to grasp due to the small diameter of the first and second wire limbs. For persons suffering from arthritis the problem is especially acute. Various attempts have been made to solve the problem.

U.S. Pat. No. 3,806,997 issued to Niwa discloses a safety pin having a non-slip plastic body. Niwa solves the aforementioned problem by providing a gripping mass which allows for easier handling of the safety pin. The safety pin designed by Niwa suffers from the drawback in that it cannot be used with a conventional safety pin. Niwa discloses attaching the gripping mass to an unconventional wire pin arrangement having a free arm with a pointed end and a mounting arm embedded in the gripping mass. Thus Niwa does not disclose an attachment for-a conventional safety pin but instead discloses a redesigned safety pin. U.S. Pat. Nos. 4,030,166(Betters), 3,883,930(Bagnasco), and 4,071,927(Bagnasco) all disclose redesigned safety pins which have a larger gripping area than the conventional safety pin.

The attachment of the present invention can be used as an identification tag for the blind or sight impaired. The attachment is provided with projections which enable the blind to determine a given characteristic associated with the item to which it is attached. If desired, braille or other indicia can be used. One advantage of using the attachment as an identification tag is that if the safety pin to which it is attached ever breaks or rusts it can be applied to a new safety pin.

SUMMARY OF THE INVENTION

It is an object of this invention to provide an attachment for a safety pin which can be provided with identifying indicia to identify characteristics associated with items to which it is attached.

It is also an object of this invention to provide an attachment for a conventional safety pin which facilitates easier gripping and control thereof.

It is also an object of this invention to provide an attachment for a safety pin which can be used with different sized safety pins.

It is a further object of this invention to provide an attachment for a safety pin which minimizes rotation or undesirable instability of the safety pin while fastening and unfastening the safety pin.

It is another object of the invention to provide an attachment for a safety pin which can be brought into locking engagement about the safety pin.

These and other objects of the invention are accomplished by providing a safety pin attachment which is capable of being releaseably locked about a conventional safety pin. The attachment has a male half and a female half which are adapted for mutual locking engagement. In one embodiment, the male half and the female half are injection molded adjacent each other and lying in the same plane, connected by a living hinge. The living hinge allows the two halves to be folded together until they are releaseably locked about the safety pin.

BRIEF DESCRIPTION OF THE DRAWINGS

FIG. 3(*c*) shows a cross section of the attachment laid open at lines C—C.

FIG. 4 shows a cross section of an alternative embodiment of the attachment at lines C—C.

FIG. 5(*a*) shows cross section A—A of an alternative embodiment of the attachment laid open.

FIG. 5(*b*) shows a cross section B—B of an alternative embodiment of the attachment laid open.

FIG. 5(*c*) shows cross section C—C of an alternative embodiment of the attachment laid open.

DETAILED DESCRIPTION

Figure 1:
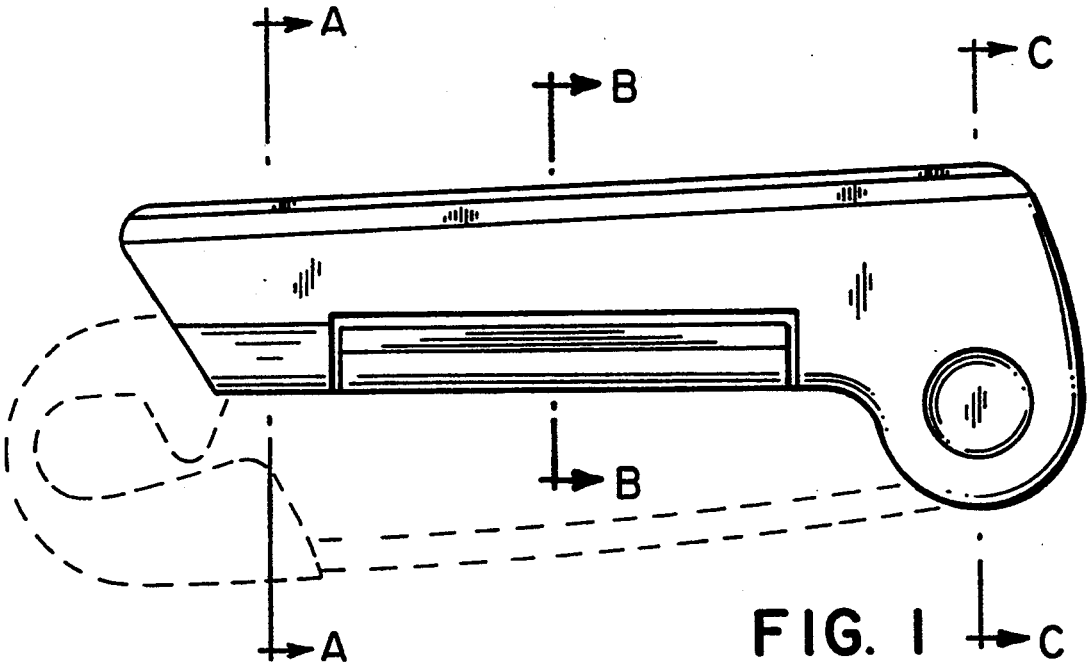
FIG. 1 shows a side view of the attachment locked around a conventional safety pin.

Referring now to FIG. 1 a side view of the attachment 10 of the present invention locked around a conventional safety pin 12 is shown.

The conventional safety pin 12 has first and second wire limbs 20 and 22 respectively. A coiled portion 24 connects limbs 20 and 22 and allows for movement of limb 22 relative to limb 20 as is well known. Cap 26 at the end of limb 20 has an opening 27 opposite limb 20 which is adapted for locking engagement with the free end 28 of limb 22.

The attachment 10 has a central portion 19 and a first end 32 which secures the coiled portion 24 of the safety pin 12. The other end 34 of the attachment 10 secures the cap 26 of the safety pin 12. It should be noted at this point that the term secure is not meant to denote a rigid locking engagement. The ends 32 and 34 allow for a very limited amount of relative movement of the pin 12, allowing one attachment to be used with several different sized safety pins 12 as will be explained later. The attachment 10 has an interiorly disposed void 35 the dimensions of which are indicated by lines 31 and 33.

Figure 2:
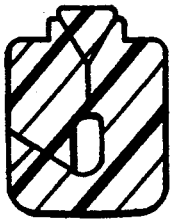
FIG. 2 shows a cross section of the attachment at lines B—B, FIG. 3(*a*) shows a cross section of the attachment laid open at lines A—A.

Referring now to FIG. 2, a cross section of the attachment 10 taken at lines B—B is shown. The attachment 10 has a male half 29 and a female half 37 which are capable of locking engagement via latch 30 which extends over to the female half 37. The attachment 10 is locked around the safety pin 12 when latch surface 36 abuts surface 38 of the female half 37.

Figure 3A:
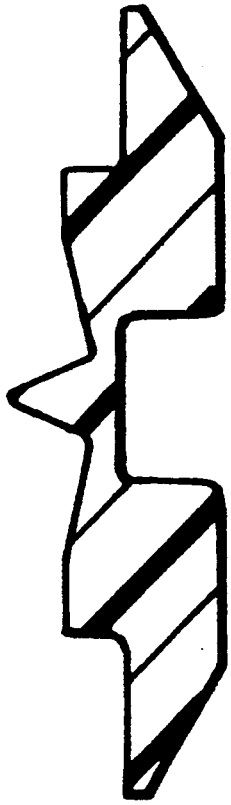
FIG. 3(*b*) shows a cross section of the attachment laid open at lines B—B.
Figure 3B:
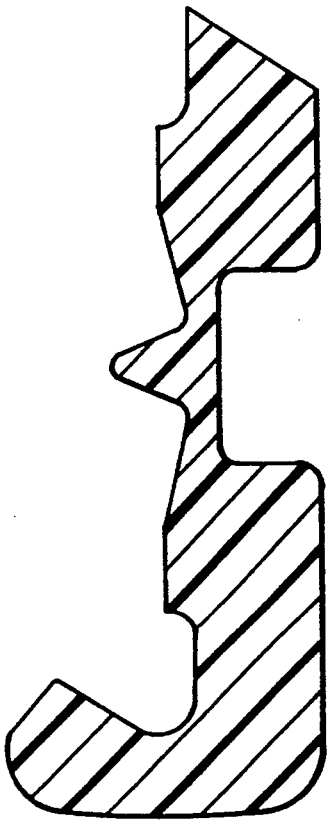
Figure 3C:
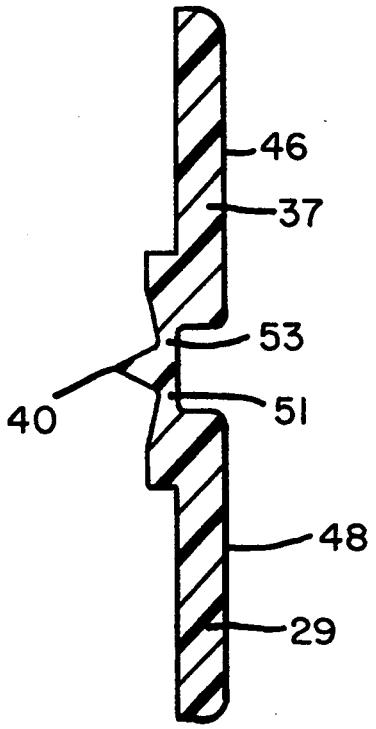

Referring now to FIG. 3(*a*) cross section A—A of the attachment laid open is shown. This is essentially a cross section of end 34. Male half 29 and female half 37 are connected by a hinge 40 which has narrow portions 51 and 53. Hinge 40 and portions 51 and 53 comprise a living hinge arrangement as is known in the art. The attachment 10 can be molded with the living hinge flat or open as is shown here. The attachment 10 can also be molded around a safety pin 12 provided the molding technique allows for a reusable hinge arrangement. The attachment 10 can also be molded as two separate halves which can be locked together.

FIG. 3(*b*) shows cross section B—B which bisects a central portion 19 of the attachment 10 between points 17 and 18 as shown in FIG. 1. At this point, the male half 29 is relatively massive compared to the female half 37 due to transversally extending latch 30. FIG. 3(*c*) shows that at cross section C—C both male and female halfs are identical.

In operation, wire limb 20 of the safety pin 12 is placed within the void 35 of the attachment 10. The attachment 10 is then locked around the safety pin 12 by pressing together exterior surfaces 46 and 48 in the direction of arrows A1 and A2 until surfaces 36 and 38 of latch 30 meet.

As previously stated, the attachment 10 can be used with different sized safety pins 12. The range of sizes is not, of course, unlimited. In order for the attachment 10 to function properly, the cap 26 must be capable of engagement with end 34 of the attachment 10 while the coiled portion 24 is within the confines of end 32. Of course, wire limb 20 must fit within inner surfaces 42 and 44 of void 35 in order for the attachment to close.

It should be noted at this point that the attachment 10 can be made from injection molded plastic. Of course any other suitable material and manufacturing method can be used.

Referring now to FIG. 4 a cross section of the locking arrangement of an alternative embodiment is shown. The locking arrangement has a mushroom shaped projection 162 extending across the end (32, FIG. 1) which secures the coiled portion 24 of the safety pin 12. The projection 162 extends through the coiled portion 24 of the safety pin. Projection 162 is wider at the extreme end 164 so it can provide a "snap-fit" with aperture 170.

Referring now to FIG. 5(*b*), male 129 and female 137 halfs of the attachment 10 are identical through the central portion 19. FIG. 5(*a*) shows that the two embodiments are identical at section A—A.

Figure 6:
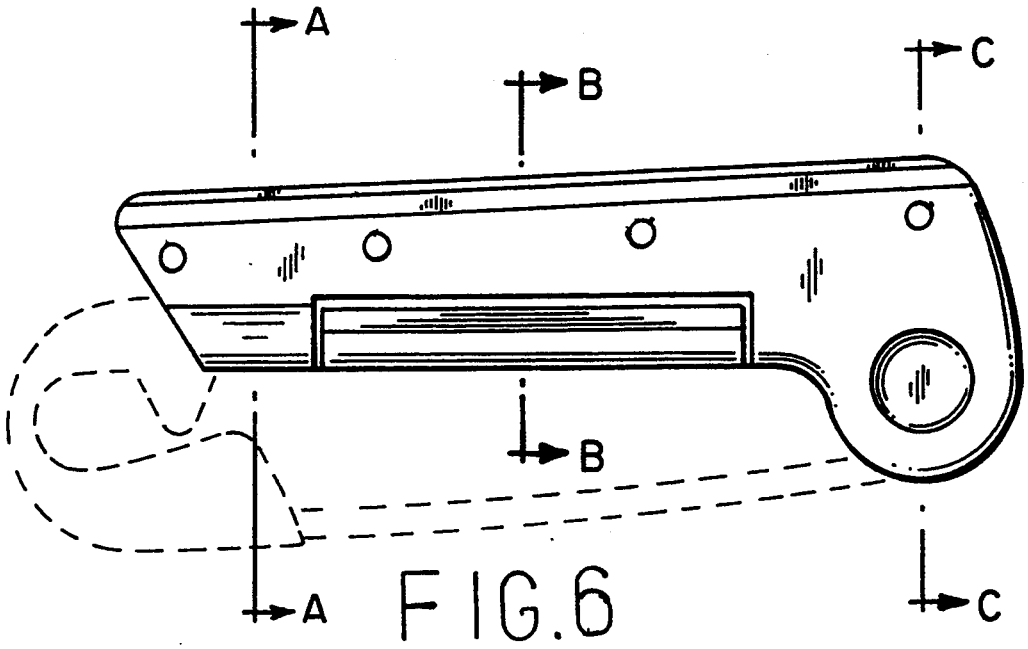
FIG. 6 shows a side view of the attachment with molded projections.
Figure 7:
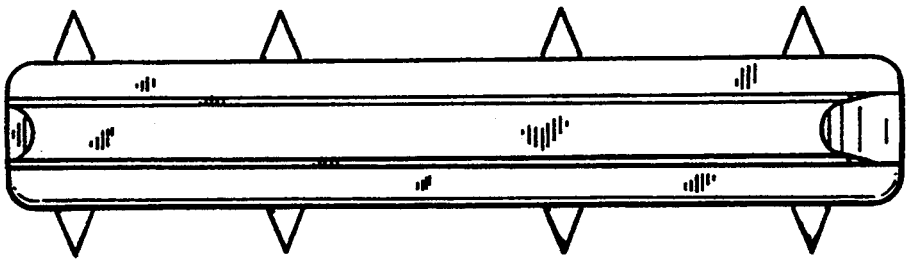
FIG. 7 shows a bottom view of the attachment with molded projections.

FIGS. 6 and 7 show projections 200 which are used as identifying indicia. The projections 200 are conical in shape and are molded at the time the attachment 10 is made so that a unitary construction is obtained. Of course, if desired the projections 200 can be attached by any other feasible means. Also, any other identifying indicia can be applied including, but not limited to braille, raised lettering or the like.

Referring now to FIG. 7, 8 projections 200 are shown. 8 projections 200 can correspond to a characteristic of an item such as color or size. Any scheme can be used to identify the characteristics of the item, for instance the 8 projections 200 can be considered as either 8 projections 200 total or 4 projections 200 total. Also, the pattern shown in FIGS. 6 and 7 is only exemplary, any number or arrangement of projections 200 can be used, limited by the surface area of the attachment 10.

I claim:

1. A one piece attachment for a lockable safety pin formed of resilient plastic material, the safety pin having first and second wire limbs, a coiled portion connecting adjacent ends of said first and second wire limbs, a cap at the end of the first wire limb, the attachment comprising:

a longitudinally extending main body, said main body having a male half and a female half attached to each other by a centrally located living hinge, the male half and female half having equal longitudinal dimensions, both said male half and said female half having opposing first and second ends, said opposing first ends are foldable about said hinge for securing said coiled portion of said safety pin, and said opposing second ends for securing said cap;

said male half and said female half being capable of releasable locking engagement about said safety pin, said first end of said male half having a transversally extending projection, and said first end of said female half having an aperture capable of locking engagement with said projection for securing said body to said safety pin; said main body having an exterior surface, the exterior surface having a plurality of conical projections extending therefrom.

2. The attachment of claim 1 where said male half has a transversally extending locking arm extending from a central portion of the male half and capable of locking engagement with a corresponding central portion of said female half.

3. The attachment of claim 1 where said attachment is formed by injection molding.

4. The attachment of claim 1 where said attachment is injection molded so that said male half and said female half are lying adjacent in the same plane and connected by a flexible connecting means.

5. The attachment of claims 1–5 where said attachment is capable of being used with different sized safety pins.

* * * * *